US006159877A

United States Patent [19]

Scholz et al.

[11] Patent Number: 6,159,877

[45] **Date of Patent: *Dec. 12, 2000**

[54] FABRIC BACKING FOR ORTHOPEDIC SUPPORT MATERIALS

[75] Inventors: Matthew T. Scholz; Miroslav Tochacek, both of Woodbury; Jason L. Edgar, Bloomington, all of Minn.

[73] Assignee: 3M Innovative Properties Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/023,444

[22] Filed: Feb. 13, 1998

Related U.S. Application Data

[63] Continuation of application No. 08/441,185, May 15, 1995, Pat. No. 5,744,528, and a continuation of application No. 08/183,160, Jan. 19, 1994, Pat. No. 5,540,982, which is a continuation-in-part of application No. 08/009,923, Jan. 25, 1993, Pat. No. 5,512,354.

[51] Int. Cl.[7] ..... B32B 27/04; A61F 5/01

[52] U.S. Cl. ..... 442/103; 442/164; 442/313; 428/902; 428/903; 602/8

[58] Field of Search ..... 442/306, 312, 442/313, 164, 180, 103; 428/902, 903; 602/8

[56] References Cited

U.S. PATENT DOCUMENTS

| | | | |
|---|---|---|---|
| 3,630,194 | 12/1971 | Boardman | 128/90 |
| 3,762,980 | 10/1973 | Maggio | 156/461 |
| 3,882,857 | 5/1975 | Woodall, Jr. | 128/90 |
| 3,908,644 | 9/1975 | Neinart et al. | 128/90 |
| 3,932,526 | 1/1976 | Koshar | 260/607 A |
| 4,286,586 | 9/1981 | Potts | 128/90 |
| 4,411,262 | 10/1983 | Von Bonin et al. | 128/90 |
| 4,427,002 | 1/1984 | Baron et al. | 128/83 |
| 4,433,680 | 2/1984 | Yoon | 128/90 |
| 4,502,479 | 3/1985 | Garwood et al. | 128/90 |
| 4,574,793 | 3/1986 | Lee et al. | 128/90 |
| 4,588,615 | 5/1986 | Otty | 427/294 |
| 4,609,578 | 9/1986 | Reed | 428/76 |
| 4,657,807 | 4/1987 | Fuerstman | 428/263 |
| 4,667,661 | 5/1987 | Scholz et al. | 128/90 |
| 4,668,563 | 5/1987 | Buese | 428/230 |
| 4,856,502 | 8/1989 | Ersfeld et al. | 128/90 |
| 4,871,845 | 10/1989 | Buchanin | 544/87 |
| 4,940,047 | 7/1990 | Richter et al. | 128/90 |
| 4,984,566 | 1/1991 | Sekine et al. | 128/90 |
| 5,014,403 | 5/1991 | Buese | 28/170 |
| 5,027,804 | 7/1991 | Forsyth et al. | 128/90 |
| 5,298,303 | 3/1994 | Kerr et al. | 428/35.7 |
| 5,436,031 | 7/1995 | Payer | 427/289 |
| 5,445,599 | 8/1995 | Edenbaum | 602/76 |
| 5,474,522 | 12/1995 | Scholz et al. | 602/8 |
| 5,476,440 | 12/1995 | Edenbaum | 602/8 |
| 5,512,354 | 4/1996 | Scholz et al. | 428/231 |
| 5,540,982 | 7/1996 | Scholz et al. | 428/231 |
| 5,744,528 | 4/1998 | Callinan et al. | 524/265 |

FOREIGN PATENT DOCUMENTS

| | | |
|---|---|---|
| 0 407 056 | 1/1991 | European Pat. Off. . |
| 2257440 | 1/1993 | United Kingdom . |
| WO 90/02539 | 3/1990 | WIPO . |

OTHER PUBLICATIONS

Translation of "Microfasern—Modewelle Oder Standard von Morgen?", I. Heidenreich and H. Ninow, Melliand Textilberichte Dec. 1991, pp. 971 to 977.

M. Isaacs III, *Textile World*, 48–50 (Mar. 1991).

Heidenreich et al., *Melliand English*, Dec. 1991, E391–E394.

*Primary Examiner*—Terrel Morris
*Assistant Examiner*—Cheryl Juska
*Attorney, Agent, or Firm*—Yen Tong Florczak

[57] ABSTRACT

The present invention provides a unique knit construction having a nonfiberglass yarn for controlling stiffness, i.e., a stiffness-controlling yarn. The knit may optionally have a nonfiberglass microdenier yarn and/or a heat shrinkable yarn.

26 Claims, 4 Drawing Sheets

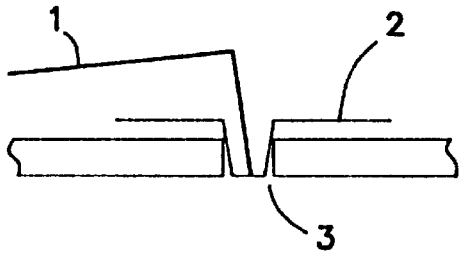
FIG. 5
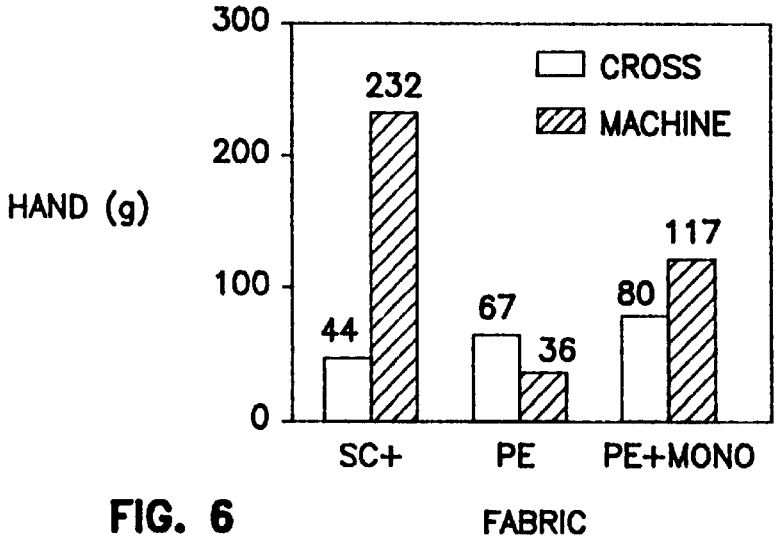
FIG. 6
FIG. 7
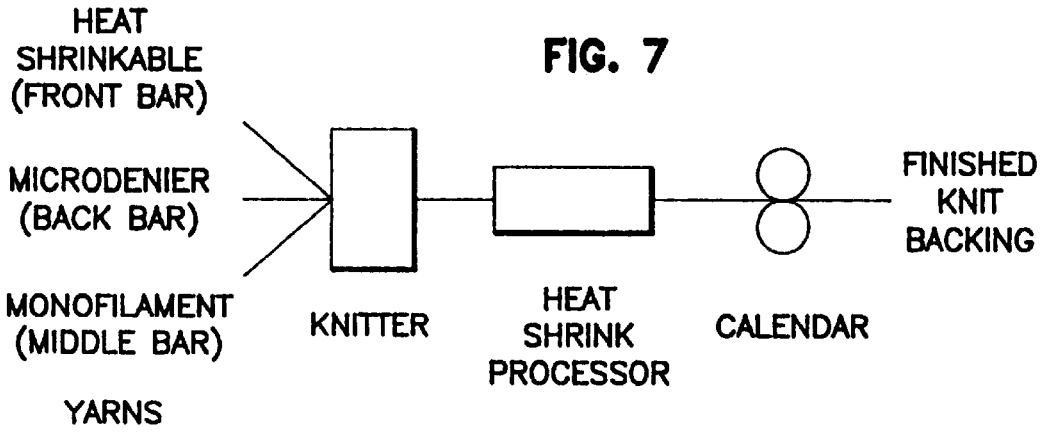

FABRIC BACKING FOR ORTHOPEDIC SUPPORT MATERIALS

This is a continuation of application Ser. No. 08/441,185 filed May 15, 1995 now U.S. Pat. No. 5,744,528 filed Jan. 19, 1994 and a continuation of application Ser. No. 08/183,160, now U.S. Pat. No. 5,540,982 which is a continuation-in-part of application Ser. No. 08/009,923, filed Jan. 25, 1993 now U.S. Pat. No. 5,512,354.

FIELD OF THE INVENTION

The present invention relates to knit fabrics. More specifically, the present invention relates to knit fabrics used as backings for orthopedic immobilization devices such as orthopedic casting tapes.

BACKGROUND OF THE INVENTION

Current orthopedic immobilization or support materials, e.g., casting tapes, are composed of a fabric backing and a curable compound such as plaster-of-paris or a synthetic resinous material. The fabric used in the backing serves several important functions. For example, it provides a convenient means of delivering the curable compound. It also helps reinforce the final composite cast. Furthermore, for an orthopedic casting material that incorporates a curable resin, use of a backing material with numerous voids, i.e., a backing with an apertured configuration, ensures adequate porosity. This allows a sufficient amount of curing agent, such as water, to contact the resin and initiate cure. This also ensures that the finished cast is porous, breathable, and comfortable for the patient.

The fabric used in many of the backings of orthopedic casting materials on the market is made of fiberglass. Such fiberglass backing materials generally provide casts with strength superior to casts that use synthetic organic fiber knits, gauze, nonwovens, and other nonfiberglass composite backings. Although fiberglass backing materials provide superior strength, they are of some concern to the medical practitioner during the removal of casts. Because casts are removed using conventional oscillatory cast saws, fiberglass dust is typically generated.

Although the dust is generally classified as nonrespirable nuisance dust, and therefore not typically hazardous, many practitioners are concerned about the effect inhalation of such fiberglass dust particles may have on their health. Furthermore, although casts containing fiberglass generally have improved x-ray transparency compared to that of plaster-of-paris casts, the knit structure is visible, which can interfere with the ability to see fine detail in a fracture.

In developing backing materials for orthopedic casts, conformability of the material is an important consideration. In order to provide a "glove-like" fit, the backing material should conform to the shape of the patient's limb receiving the cast. This can be especially difficult in areas of bony prominences such as the ankle, elbow, heel, and knee areas. The conformability of a material is determined in large part by the longitudinal extensibility, i.e., lengthwise stretch, of the fabric.

Conformable fiberglass backings have been developed, however, special knitting techniques and processing equipment are required. To avoid the need for special techniques and equipment, nonfiberglass backing materials have been developed to replace fiberglass. However, many of the commercially available nonfiberglass backings, such as those containing polyester or polypropylene, also have limited extensibility, and thus limited conformability.

Furthermore, the casts made from low modulus organic fibers are significantly weaker than casts made from a fiberglass casting tape. That is, the modulus of elasticity (ratio of the change in stress to the change in strain which occurs when a fiber is mechanically loaded) for many nonfiberglass materials (about 5–100 g per denier), e.g., polyester (about 50–80 grams per denier), is far lower than that for fiberglass (about 200–300 grams per denier) and as such provides a lower modulus, less rigid, cured composite. For this reason, the resin component of the cured composite needs to support a far greater load than it does when fiberglass fabric forms the backing. Thus, greater amounts of resin are generally required with nonfiberglass backings. This is not desirable because large amounts of curable casting compound may result in resin pooling, high exotherm, and reduced cast porosity.

The extensibility, and thereby conformability, of some fiberglass or polyester knit backing materials has been improved by incorporating elastic yarns into the wales of a chain stitch. The use of a backing that incorporates highly elastic yarns is not necessarily desirable, however, because of the possibility of causing constriction and further injury to the limb if the casting tape is not carefully applied. The constriction results from a relatively high elastic rebound force. Thus, inelastic or only slightly elastic stretch is preferred. A second characteristic that can be a drawback of these backings is the tendency to wrinkle longitudinally when the backing is extended. This results in decreased conformability and a rough surface.

Thus, a need exists for a backing material that is sufficiently conformable to a patient's limb, has low potential for constriction, resists wrinkling during application, and provides a cured cast that exhibits high strength, rigidity, and porosity. Also, a need exists for a backing material that is radiolucent, e.g., transparent to x-rays, in addition to the above-listed characteristics.

RELATED APPLICATIONS

Of related interest are the following U.S. Pat. Nos. 5,354,259; 5,405,643; 5,382,445; 5,346,939; 5,364,693; and Ser. No. 08/441,185 which are herein incorporated by reference.

SUMMARY OF THE INVENTION

The present invention provides backing materials for impregnation with a resin, i.e., resin-impregnated sheets. These resin-impregnated sheets are particularly useful as orthopedic support materials, i.e., medical dressings capable of hardening and immobilizing and/or supporting a body part. Although referred to herein as resin-impregnated "sheets," such hardenable dressings can be used in tape, sheet, film, slab, or tubular form to prepare orthopedic casts, splints, braces, supports, protective shields, orthotics, and the like. Additionally, other constructions in prefabricated shapes can be used. As used herein, the terms "orthopedic support material," "orthopedic immobilization material," and "orthopedic casting material" are used interchangeably to encompass any of these forms of dressings, and "cast" or "support" is used to include any of these orthopedic structures.

Typically, the backing materials of the present invention are used in orthopedic casting tapes, i.e., rolls of fabric impregnated with a curable casting compound. The backing materials of the present invention provide thin casting tapes that are advantageously wrinkle-free during application. Furthermore, they provide superior conformability and moldability without excessive elasticity.

Preferably, the backing materials of the present invention are made from a nonfiberglass-containing fabric. The preferred nonfiberglass backing materials provide superior resin holding capacity compared to other nonfiberglass and fiberglass backing materials. In this way, when coated with resin formulations, the preferred nonfiberglass backing materials of the present invention have the strength and durability of conventional fiberglass casts while remaining radiolucent, e.g., transparent to x-rays.

These and other advantageous characteristics are imparted by the use of a unique knit construction having a nonfiberglass microdenier yarn in the fabric of the backing. Preferably, the nonfiberglass microdenier yarn is used in combination with a stretch yarn, preferably a heat shrinkable yarn. In alternative preferred embodiments, the nonfiberglass microdenier yarn can be used in combination with a nonfiberglass yarn for controlling stiffness, i.e., a stiffness-controlling yarn. More preferably, the nonfiberglass microdenier yarn is in combination with a stretch yarn and a nonfiberglass stiffness-controlling yarn. Most preferably, the nonfiberglass microdenier yarn is in combination with a heat shrinkable, elastically extensible yarn and a nonfiberglass stiffness-controlling yarn. The stiffness-controlling yarn is preferably a monofilament yarn. The monofilament yarn is generally inelastic having a modulus of about 5–100 grams per denier, and preferably about 15–50 grams per denier.

This combination of yarns is used in a unique knit structure that has the heat shrinkable yarn or stretch yarn in the wales of the chain stitch, the microdenier yarn in the weft in-lay, and the stiffness-controlling yarn, preferably monofilament yarn, also in the weft as a weft insertion. Although this combination of yarns is advantageously used in the backing fabric of an orthopedic support material, it can be used in any application where a highly conformable and moldable fabric is desired.

The fabric is prepared by a warp knitting and heat shrinking process followed by a process by which the fabric is calendered flat to reduce thickness. That is, once the yarns are knitted into the desired configuration, the fabric thickness is reduced by passing it through a hot pressurized set of calender rollers to iron the fabric. In certain embodiments, the knit structure is further annealed in a heating cycle to set the stiffness-controlling yarn in a new three-dimensional configuration.

BRIEF DESCRIPTION OF THE DRAWINGS

FIG. 5 is a schematic of a hand testing fixture with a piece of fabric in position for testing.

FIG. 6 is a graph of the hand testing results (in grams per 8.2 cm width of sample material) for fiberglass containing fabric (SC+), fabric made from polyester microdenier yarn (PE), and fabric made from polyester microdenier yarn and nylon monofilament yarn (PE+mono).

FIG. 7 is a schematic of a preferred process of the present invention for making a fabric out of a heat shrinkable yarn, a microdenier yarn, and a monofilament yarn.

DETAILED DESCRIPTION OF THE INVENTION

Figure 1A:
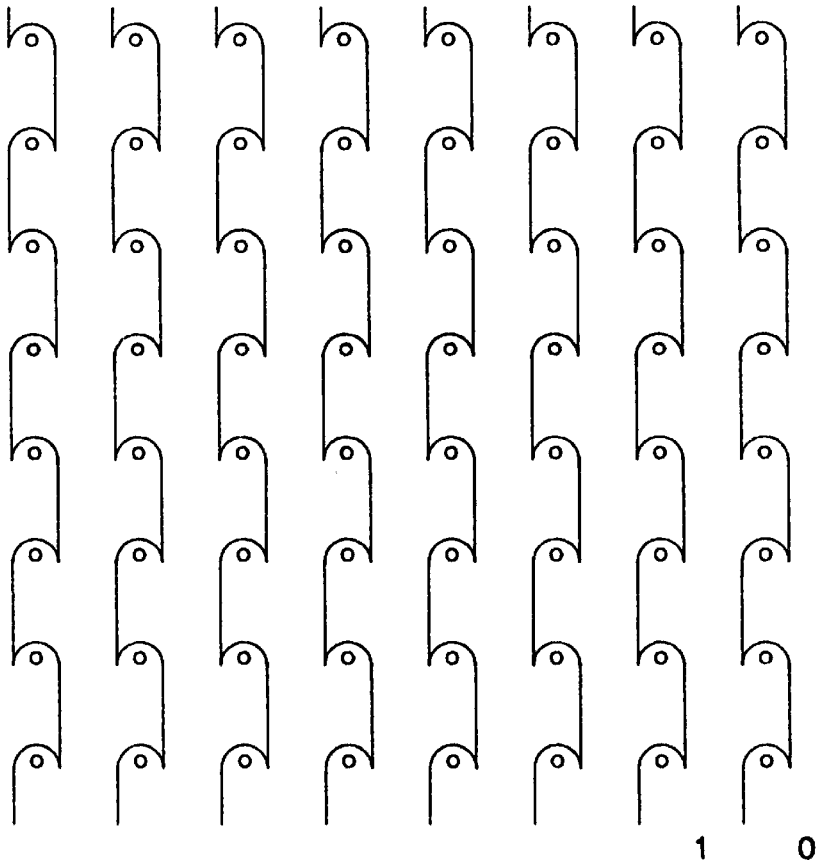
FIG. 1*a* is a schematic of a chain stitch in a three bar warp knit construction.

The present invention provides a resin-impregnated sheet material, preferably for use as a backing component of an orthopedic immobilization material such as a casting tape. The backing component acts as a reservoir for a curable casting compound, e.g., a resinous material, during storage and end-use application of the casting tape. That is, the fabric used to form the backing of an orthopedic support material, such as a casting tape, is impregnated with a curable resin such that the resin is thoroughly intermingled with the fabric fibers and within the spaces created by the network of fibers. Upon cure, the resin polymerizes and cures to a thermoset state, i.e., a crosslinked state, to create a rigid structure.

As a result of the fabric used in the backings of the present invention in combination with the preferred resin systems, the backings provide highly extensible orthopedic support materials, e.g., casting tapes, having an extensibility, strength, and durability equivalent to, or superior to, that of conventional fiberglass products. Furthermore, the backing fabrics, i.e., backing materials, of the present invention advantageously provide superior conformability and moldability, without excessive elasticity. Certain preferred fabrics of the present invention also provide increased resin holding capacity relative to conventional fiberglass and nonfiberglass products.

In general, the backing materials of the present invention are constructed from fabrics that are relatively flexible and stretchable to facilitate fitting the orthopedic support material around contoured portions of the body, such as the heel, knee, or elbow. The fabrics of the present invention have an extensibility in the lengthwise direction of about 15–100% after heat shrinking and calendering (processing steps discussed below), and preferably about 40–60%, when measured one minute after applying a load of 1.50 lb/in (2.6 newtons/cm) width. These extensibility values are all understood to be taken after calendering, if a calendering step is employed. More preferably, the extensibility is about 45–55% after calendering under this same load. Although above about 55% extensibility some advantage is realized, the greatest advantage is realized in the range of about 5% to about 55% because above 55% the conformability is not significantly increased as compared to the increase in tape thickness, backing density increase, and cost.

The fabrics used in the orthopedic support materials of the present invention must have certain ideal textural characteristics, such as surface area, porosity, and thickness. Such textural characteristics effect the amount of resin the backing can hold and the rate and extent to which the curing agent, e.g., water, comes in contact with the bulk of the curable resin impregnated in the fabric. For example, if the curing agent is only capable of contacting the surface of the resin, the major portion of the resin would remain fluid for an extended period resulting in a very long set time and a weak cast. This situation can be avoided if the resin layer is kept thin. A thin resin layer, however, is typically balanced against the amount of resin applied to the fabric to attain sufficient rigidity and formation of sufficiently strong bonding between layers of tape. A thin resin layer can be achieved at appropriate resin loadings if the fabric is sufficiently thin and has a relatively high surface-to-volume ratio in a porous structure.

The thickness of the fabric is not only optimized in view of the resin loading and resin layer thickness, but also in view of the number of layers in a cast.

That is, the thickness of the fabric is balanced against the resin load, resin layer thickness, and number of layers of tape in a cast. Typically, a cast consists of about 4–12 layers of overlapping wraps of tape, preferably about 4–5 layers in nonweight-bearing uses and 8–12 layers in weight-bearing areas such as the heel. Thus, a sufficient amount of curable resin is applied in these few layers to achieve the desired ultimate cast strength and rigidity. The appropriate amount of curable resin can be impregnated into the backing of the present invention using fabrics having a thickness of about 0.020–0.060 inches (0.05–0.15 cm). Preferably, the fabrics are thin, i.e., having a thickness of less than about 0.050 inches (0.13 cm). More preferably, the fabrics of the present invention have a thickness of about 0.030–0.040 inches (0.076–0.10 cm) measured using an Ames Gauge Co. (Waltham, Mass.) 202 thickness gauge with a one-inch (2.54 cm) diameter contact.

The fabrics of the present invention are apertured, i.e., mesh fabrics. That is, the fabrics have openings that facilitate the impregnation of the curable resin and the penetration of the curing agent, e.g., water, into the fabric. These openings are also advantageous because they allow for air circulation and moisture evaporation through the finished cast. Preferably, the fabrics of the present invention have about 60–450 openings per square inch (6–70 openings per square centimeter). More preferably, there are about 125–250 openings per square inch (19–39 openings per square centimeter). An opening is defined as the mesh equivalent of the knit. The number of openings is obtained by multiplying the number of wales per inch (chain stitches along the lengthwise direction of fabric) by the number of courses (i.e., rows that run in the cross direction of fabric).

These and other advantageous characteristics are imparted to the fabric in part through the use of a unique knit construction having a nonfiberglass microdenier yarn in the fabric of the backing. Preferably, the nonfiberglass microdenier yarn is used in combination with a stretch yarn, preferably a heat shrinkable yarn. In alternative preferred embodiments, the nonfiberglass microdenier yarn can be used in combination with a nonfiberglass stiffness-controlling yarn. More preferably, the nonfiberglass microdenier yarn is in combination with a stretch yarn and a nonfiberglass stiffness-controlling yarn. Most preferably, the nonfiberglass microdenier yarn is in combination with a heat shrinkable, highly extensible yarn, and a nonfiberglass stiffness-controlling yarn.

Thus, the most preferred fabrics of the present invention do not contain fiberglass yarns. This preferred combination of yarns is used in a unique knit structure. The preferred fabric is prepared by a three-bar warp knitting process. A front bar executes a chain stitch with a stretch yarn, preferably a heat shrinkable yarn. A back bar lays in a microdenier yarn, and the middle bar lays in a stiffness-controlling yarn, preferably a monofilament yarn. A back and middle bars can lay in yarns over any number of needles. This is generally only controlled by the limits of the knitting machine. Generally, the stiffness-controlling yarn is laid in under more needles than the microdenier yarn, and is therefore referred to as a weft insertion. Furthermore, the in-lay yarns can be overlapping or non-overlapping. That is, each in-lay yarn can be inserted with or without overlapping of other in-lay and/or insertion yarns, i.e., other stiffness-controlling yarns or microdenier yarns. As used herein, an "overlapping" configuration is one in which multiple yarns pass through a single loop of the wale stitch.

Figure 1B:
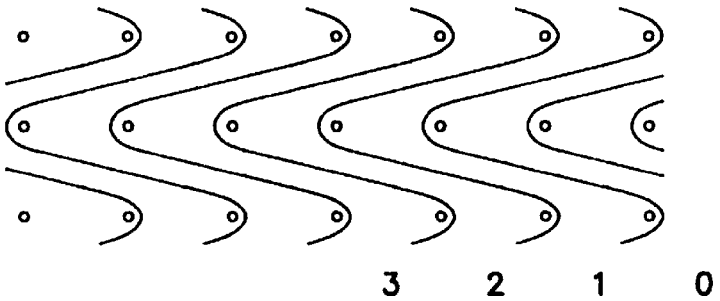
FIG. 1*b* is a schematic of a weft in-lay in a three bar warp knit construction.
Figure 1C:
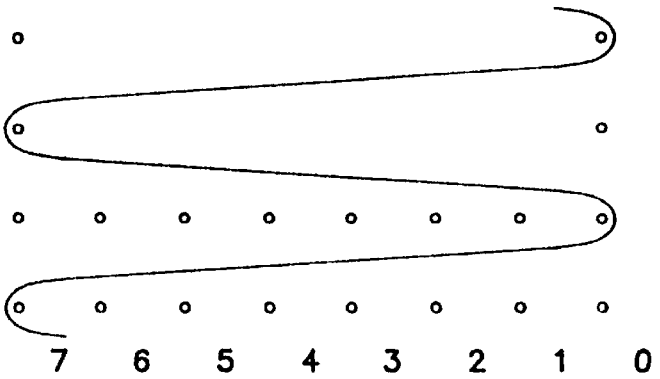
FIG. 1*c* is a schematic of a weft insertion in a three bar warp knit construction.
Figure 1D:
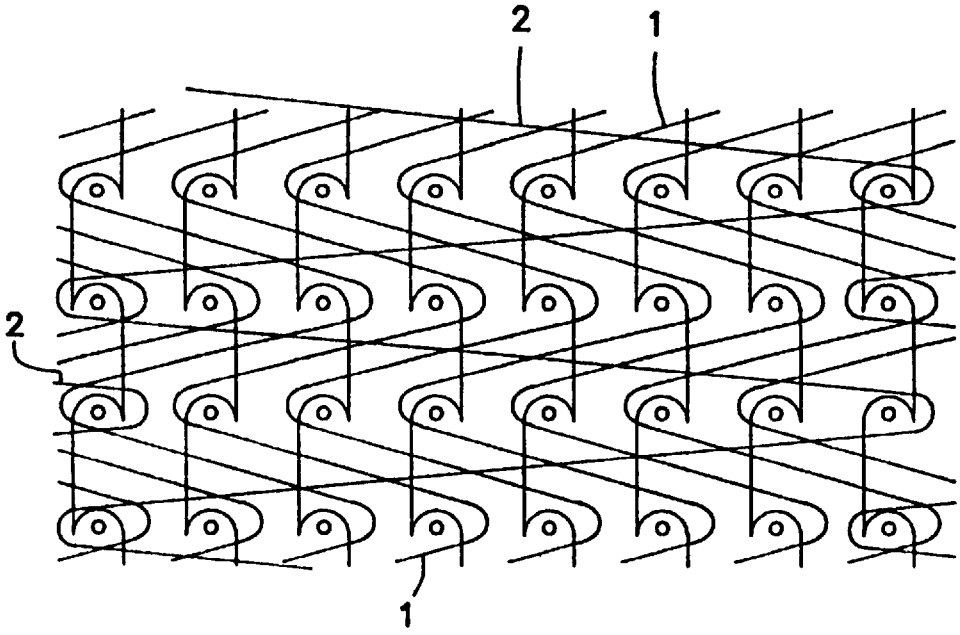
FIG. 1*d* is a schematic of a three bar warp knit construction of a preferred fabric of the present invention.

Referring to FIGS. 1*a–d*, the knit structure is preferably a three bar warp knit construction. The first lapping bar puts the stretch yarn, preferably the heat shrinkable yarn, in the wales of a chain stitch (FIG. 1*a*). The lapping order for each yarn is /1-0/0-1/. The second lapping bar puts the microdenier yarn in as a weft in-lay (FIG. 1*b*). The lapping order for each yarn is preferably /0-0/3-3/. The third lapping bar puts the stiffness-controlling yarn, preferably monofilament yarn, also in the weft, i.e., as a weft insertion (FIG. 1 c). The lapping order for each yarn is preferably /7-7/0-0/. A preferred composite three bar warp knit construction is represented by the schematic of FIG. 1*d*. In this composite, the weft in-lay yarn(s) (1), i.e., the microdenier yarn in this preferred embodiment, and the weft insertion yarn(s) (2), i.e., the stiffness-controlling yarn in this preferred embodiment, are laid in from opposite directions.

As stated above, a basic function of the backing in an orthopedic immobilization material, such as a casting tape, is delivery of the curable casting compound, e.g., resin. The amount of curable casting compound delivered must be sufficient such that adequate layer to layer lamination is achieved, but should not be too great so as to result in resin "pooling" to the bottom of the roll under the force of gravity. Because the modulus of elasticity, i.e., modulus, for nonfiberglass fabrics such as polyester is far lower than that for fiberglass, polyester backings provide little support to the cured composite. Thus, the nonfiberglass backing needs to hold a greater amount of resin per unit area in order to achieve fiberglass-like strength.

The fabrics of the present invention are capable of holding a sufficiently large amount of resin while not detrimentally effecting the porosity and conformability of the casting material. In addition, preferred fabrics containing microdenier yarns are expected to provide clearer and more vivid printed fabrics than can be obtained with conventional casting tapes. This is believed to be due to the higher surface area of the microdenier yarn.

An alternative method of increasing the ability of the knit fabrics of the invention to hold resin is by texturizing. The texturized fabrics may be obtained by texturizing them into the fabric after knitting or by texturizing the fabric before knitting. Preferably the yarn is texturized before the fabric is knit. Various methods of texturizing are known to those skilled in the art and are described, e.g. in Introductory Textile Science, Fifth Edition (1956) by M. L. Joseph (Holt, Rinehart and Winston, New York). These methods include steam or air jet treatment, various twisting techniques such as the false twist method, gear crimping, the stuffer box method, the knife edge method, draw texturizing and the like. Preferably air jet treatment is used.

Nonfiberglass yarns formed from very small diameter fibers or filaments, i.e., no greater than about 1.5 denier, are used in the present invention. These yarns are referred to herein as nonfiberglass "microdenier" yarns. Herein, microdenier yarns are those having a diameter of no greater than about 1.5 denier, which is a slightly larger diameter than is used in the generally accepted definition of microdenier yarns. Preferably, the nonfiberglass microdenier yarns used in the present invention are formed from fibers or filaments having a diameter of no greater than about 1.0 denier. These yarns contribute to a fabric that is very conformable and moldable with an extremely soft "hand," i.e., flexibility. Fabrics made from entirely these yarns produce an almost silk-like feel with excellent drapability. Such a fabric is useable as a backing in an orthopedic support material.

The microdenier yarns can be made of any organic staple fiber or continuous filament of synthetic or natural origin. Suitable staple fibers and filaments for use in the microdenier yarn include, but are not limited to, polyester, polyamide, polyaramid, polyolefin, rayon, halogenated polyolefin, copolymers such as polyether esters, polyamide esters, as well as polymer blends. Preferably, the microdenier yarns are made of rayon and polyester, which are available from several manufacturers, including BASF Fibers (Williamsburg, Va.), DuPont (New York, N.Y.), and Dixie Yarns (Charlotte, N.C.). Rayon and polyester microdenier yarns are commercially available in both staple and continuous filament form, as well as in partially oriented yarn filaments and fully oriented staple yarns.

More preferably, the microdenier yarns are made of polyester fibers or filaments. Generally, this is because polyester yarns are relatively inexpensive, currently available, and regarded as relatively safe and environmentally friendly. Furthermore, polyester yarns do not require drying prior to coating with a water curable resin due to a low affinity for atmospheric moisture, and they have a high affinity for most resins. One particularly preferred yarn is an 18/2 polyester spun yarn with a filament diameter of 1.2 denier, which is available from Dixie Yarns (Charlotte, N.C.).

The microdenier yarns used in the present invention can be made of a combination of two or more types of the above-listed fibers or filaments. The filaments or staple fibers can be partially oriented and/or texturized for stretch, if desired. Furthermore, if desired dyed microdenier yarns can be used.

Microdenier yarns can be combined with yarns made from fibers or filaments of larger diameter. These larger diameter yarns can be of either synthetic, natural, or inorganic origin. That is, the microdenier yarns can be combined with larger polyester, polyamide, polyacrylonitrile, polyurethane, polyolefin, rayon, cotton, carbon, ceramic, boron, and/or fiberglass yarns. For example, these microdenier yarns could be knit in as the in-lay, i.e., as a weft partial in-lay, with fiberglass yarn in the wale, i.e., chain stitch. If fiberglass yarns are used, typically only about 40–70% of the total weight of the fabric results from the fiberglass component.

The microdenier yarn is preferably made into a warp knit configuration. In a backing fabric having only microdenier yarns, both the weft and the wale are composed of microdenier yarns. Example 1 illustrates one such embodiment. Such a knit can have about 10–25 wales/inch (3.9–9.8 wales/cm) and about 5–25 stitches/inch (2.0–9.8 stitches/cm). In general, the number of stitches/inch in fabrics of the present invention can vary depending upon the yarns used and the gauge of the needle bed. Preferably, the fabrics have about 3–25 stitches/inch, more preferably about 4–15 stitches/inch, and most preferably about 5–10 stitches/inch.

Because most microdenier yarns currently on the market are not texturized for stretch, they are inelastic yarns with very little stretch. If used in the wale, i.e., chain stitch, running along the length of the fabric, they limit conformability by limiting the extensibility of the fabric. If texturized microdenier yarns, i.e., stretchable microdenier yarns, are used in combination with nontexturized microdenier yarns, the texturized microdenier yarns are used in the wale, i.e., chain stitch, and the nontexturized microdenier yarns are used in the weft.

Fabric containing microdenier yarns can be made extensible by a number of methods, however. For example, extensibility may be imparted by microcreping as described in U.S. Pat. No. 5,405,643, which is incorporated herein by reference. The microcreping of said invention requires mechanical compacting or crimping of a suitable fabric, generally a naturally occurring organic fiber or preferably a synthetic organic fiber. The fibers may be knits, wovens or nonwovens, e.g., spun laced or hydroentangled nonwovens. The process requires mechanical compacting or crimping followed by annealing.

Alternatively, stretch yarns, such as elastic stretch yarns or thermoplastic stretch yarns, can be used along the length of the fabric, preferably in the wale, to impart extensibility. Elastic stretch yarns, such as Lycra, Spandex, polyurethanes, and natural rubber, could be used as described in U.S. Pat. No. 4,668,563 (Buese) and placed in the knit as an in-lay, preferably across one needle. Thermoplastic stretch yarns, such as polyesters and polyamides, could also be used as described in U.S. Pat. No. 4,940,047 (Richter et al.)

In one embodiment, an elastic stretch yarn is knitted into the fabric under tension to provide some degree of compaction as the knit relaxes off the knitting machine. Desirable elastic stretch yarns are those of low denier, i.e., no greater than about 500 denier, preferably less than 300 denier. Such low denier elastic stretch yarns do not have as much rebound as higher denier stretch yarns. Furthermore, these yarns are characterized as having elasticity modulus of 0.02 to 0.25 grams per denier and an elongation of 200–700 percent. Suitable stretch yarns include threads of natural rubber and synthetic polyurethane such as Spandex™ and Lycra™. Thus, orthopedic casting materials containing such elastic stretch yarns have lower constriction capacity. When elastic stretch yarns are used in combination with microdenier yarns, highly conformable, highly moldable, highly elastic, composite fabrics with high resin holding capacity result.

Another method by which the conformability of the fabric containing the microdenier yarn can be improved involves using highly texturized, heat shrinkable, extensible, thermoplastic yarns. These elastic properties of these yarns are based on the permanent crimping and torsion of the threads obtained in the texturizing process and are achieved as a result of the thermoplastic properties of the materials. All types of texturized filaments can be used, such as, for example, highly elastic crimped yarns, set yarns, and highly bulk yarns. The use of this type of yarn is preferred over the use of elastic yarns because the degree of elastic rebound force in the fabric is kept very low with heat shrinkable yarns. This minimizes the chance for constriction and further injury to the limb due to too tightly applied casting tapes.

The use of a heat shrinkable yarn in the lengthwise direction, preferably in the wale, of the fabric containing microdenier yarn provides sufficient stretch to the fabric without creating too high an elastic rebound force. The heat shrinkable yarn can be a microdenier yarn texturized to be a heat shrinkable yarn using a process as described in U.S.

Pat. No. 4,940,047 (Richter et al.). Alternatively, and preferably, the heat shrinkable yarn is one of a higher denier than that of the microdenier yarn. If a heat shrinkable microdenier yarn is used it is preferably in the wale and the nonshrinkable microdenier yarn is inserted as a weft yarn.

After heat treatment, the heat shrinkable yarn shrinks and compacts the fabric. The resulting fabric can then be stretched generally to its preshrunk length, and in many cases beyond the preshrunk length. Thus, the combination of the microdenier yarn and the heat shrinkable yarn, whether a heat shrinkable microdenier or a yarn of larger denier, provides a fabric with sufficient extensibility in the lengthwise direction such that the fabric has a suitable conformability.

The heat shrinkable yarns used in the present invention are highly texturized and elastically extensible. That is, they exhibit at least about 30%, and preferably at least about 40%, stretch. They are preferably composed of highly crimped, partially oriented filaments that contract when exposed to heat. As a result, the fabric is compacted into a shorter, higher density, and thicker backing. The texturized heat shrinkable yarn is composed of relatively large denier fibers or filaments in order to achieve shrinkage forces sufficient to compact the fabric efficiently and to provide additive rebound forces. Preferably, yarn is prepared from fibers or filaments of greater than about 1.5 denier, more preferably greater than about 2.2 denier, which compact the fabric to the desired extent. The heat shrinkable yarn can be made of fibers or filaments of up to about 6.0 denier.

All types of texturized yarns that shrink upon exposure to heat can be used as the heat shrinkable yarn in the backing of the present invention. This can include highly elastic crimped yarns, set yarns, and highly bulky yarns. Upon shrinkage, the heat shrinkable yarns used in the present invention are highly extensible, i.e., greater than about 40%. This results in a fabric that is highly extensible, i.e., greater than about 45–60%, without the use of highly elastic materials.

Suitable thermoplastic heat shrinkable yarns are made of polyester, polyamide, and polyacrylonitrile fibers or filaments. Preferred heat shrinkable yarns are made of polyester and polyamide fibers or filaments. More preferably, the heat shrinkable yarns are made of polyester fibers or filaments for the reasons listed above for the microdenier yarns.

The fabric may be heated by using sources such as hot air, steam, infrared (IR) radiation, liquid medium, or by other means as long as the fabric is heated to a high enough temperature to allow the shrinkage to occur, but not so high that the filaments or fibers melt. Steam at 15 psi (10.3 newtons/cm2) works well, but requires subsequent drying of the fabric. The preferred method for shrinking polyester heat shrinkable yarn uses hot air at a temperature of about 120–180° C., preferably at a temperature of about 140–160° C. The temperature required generally depends on the source of the heat, the type of heat shrinkable yarn, and the time the fabric is exposed to the heat source, e.g., web speed through a fixed length heating zone. Such a temperature can be readily determined by one of skill in the art.

An example of a preferred heat shrinkable, texturized yarn is Power Stretch yarn produced by Unifi (Greensboro, N.C.). These yarns are composed of highly crimped partially oriented polyester fibers that contract when exposed to heat. They are available in a variety of plies and deniers. Although 300 denier plied Power Stretch yarn can be used, the preferred yarn is a single 150 denier yarn containing 68 filaments, which has 46% stretch and is available from Dalton Textiles Inc. (Chicago, Ill.). The 150 denier yarn is preferred because the recovery or rebound force of the fabric is minimized with this yarn. Furthermore, the 150 denier yarn results in a lower fabric density, which allows for a thinner more conformable backing and lowers the total resin usage, thereby reducing the amount of heat generated upon cure.

Once the fabric is heated to allow it to shrink, the fabric density, and thereby thickness, can increase substantially. In some cases the fabric thickness can increase to over 0.055 inches (0.140 cm). Preferably, the fabric is kept thin, e.g., less than about 0.050 inches (0.13 cm), and more preferably at about 0.030–0.040 inches (0.076–0.10 cm).

If the fabric is too thick, the thickness can be reduced by passing the fabric through a hot pressurized set of calender rollers, i.e., two or more rollers wherein one or more can be heated rollers that are turning in opposite directions between which fabric is passed under low tension, thereby compressing, or "calendering," the fabric. This process creates thinner fabrics that result in smoother, less bulky casts. Care should be taken to prevent over "calendering" the fabric, which could result in dramatic stretch loss, i.e., a undesirable reduction in the extensibility.

It is not desirable to reduce the fabric thickness too dramatically because this can result in significantly less resin holding capacity. Preferably the thickness is not reduced by more than about 70%, more preferably by more than about 50%, and most preferably by more than about 30% of the original thickness of the fabric. In addition, the calendering process advantageously provides some added stiffness in the cross web direction which reduces the tendency of the fabric to wrinkle during application.

Although it is conceivable to heat shrink and "iron" the fabric in a single step using hot calender rollers, it is preferable to first heat shrink the fabric and then pass it through the "ironing" step. The ironing, i.e., calendering, may be accomplished using wet or dry fabric or through the use of added steam. Preferably, the ironing is performed on dry fabric to avoid subsequent drying operations necessary prior to application of a water curable resin. In order to attain maximum extensibility in the finished product, it is desirable to fully heat shrink the fabric prior to the hot calendering operation. If the fabric is only heat shrunk partially and then "ironed," the fabric may not have a sufficient extensibility. Furthermore, the fabric may not be able to be subsequently heat shrunk to any significant degree.

Although the ironing process helps reduce wrinkling of the fabric during application, it does not eliminate it. Since preferred fabrics of the present invention use relatively low modulus organic yarns (in contrast to fiberglass), wrinkles can form during application. Wrinkles form especially when the tape is wrapped around areas where the anatomy changes shape rapidly or where the tape needs to change direction, e.g., at the heel, elbow, wrist, etc. In order to eliminate, or at least reduce, the amount of wrinkling in lower modulus tapes, the present invention preferably uses an added weft insertion of a yarn for stiffness control.

The stiffness-controlling yarn provides a means of maintaining a flat web in the cross direction during application without decreasing resin holding capacity. It can also contribute to increased extensibility of the fabric. The stiffness-controlling yarn is preferably made of a type of fiber or filament that has low shrinkage properties, i.e., less than about 15% shrinkage, i.e., preferably less than about 5%. Thus, there is little width contraction of the tape during the heat shrinking process when heat shrinkable texturized crimped yarns are used in the wale. If used in combination with nonheat shrinkable yarns, such as elastic stretch yarns, this is not necessarily a requirement.

The stiffness-controlling yarn can be made of any fiber or filament having sufficient stiffness to prevent wrinkling and add dimensional stability. It can be a multifilament or a monofilament yarn. Preferably it is a monofilament yarn, i.e., a yarn made from one filament. As used herein "sufficient stiffness" refers to yarns having a modulus of greater than about 5 grams per denier, preferably greater than about 15 grams per denier, more preferably a denier of at least about 40, and most preferably at least about 100 denier. Furthermore, these yarns generally exhibit only 100% elastic recovery at percent strains up to about 5 to 10%.

Suitable multifilament yarns are made from filaments of large denier, i.e., greater than about 5 denier per filament, and/or are highly twisted yarns. The stiffness-controlling yarn, whether monofilament or multifilament, is preferably about 40–350 denier, more preferably about 80–200 denier, and most preferably about 160–200 denier.

Suitable filaments for use in the monofilament yarn include, but are not limited to, polyester, polyamide such as nylon, polyolefin, halogenated polyolefin, polyacrylate, polyurea, polyacrylonitrile, as well as copolymers, polymer blends, and extruded yarns. Cotton, rayon, jute, hemp, and the like can be used if made into a highly twisted multifilament yarn. Yarns of round, multilobal, or other cross-sectional configurations are useful. Preferably, the monofilament yarn is made of nylon or polyester. More preferably, the monofilament yarn is made of nylon. Most preferably, the nylon monofilament yarn is of about 80–200 denier and has less than about 5% shrinkage.

The use of a monofilament yarn can also be used to advantage as an added weft insertion in fiberglass backings. This is particularly desirable in nonheat-set fiberglass backings that tend to drape and wrinkle more easily than conventional fiberglass backings. The use of a monofilament yarn in combination with fine filament fiberglass yarns, such as ECDE and ECC yarns or even finer yarns, is also particularly desirable.

The stiffness-controlling yarn can be laid in across 1–9 cm, depending on the type of knitting machine used, continuously or discontinuously across the width of the tape, and in any number of configurations. In a weft insertion, the stiffer yarn is inserted by the separate system of tubular yarn guides by reciprocal movement in the cross direction to the fabric. This is generally done under more needles in every stitch than the conventional system containing spun yarn or multifilament microdenier fiber yarns which creates the base knit structure in combination with the chain stitch. The long weft insertion is perpendicular to the chain stitch wale direction and is locked inside the base knit structure together with the yarn of the base short weft in-lay system. It is preferably positioned to ensure a nonwrinkling fabric while allowing for cross web and bias extensibility. For example, each stitch can include a single end, i.e., a yarn made of one strand, of monofilament or multiple ends depending on the number of ends of monofilament yarn employed and the number of needles over which they cross.

The stiffness-controlling yarn can be inserted in one or more segments of various lengths with or without overlapping of other weft yarns, i.e., other stiffness-controlling yarns or microdenier yarns. The preferred configuration is one in which there is no overlapping of the weft insertion yarns. Preferably, the stiffness-controlling yarn is inserted across 3–25 needles. More preferably, the stiffness-controlling yarn is laid in across 7 needles in a 6 gauge knit (6 needles/cm) without overlapping.

Figure 2:
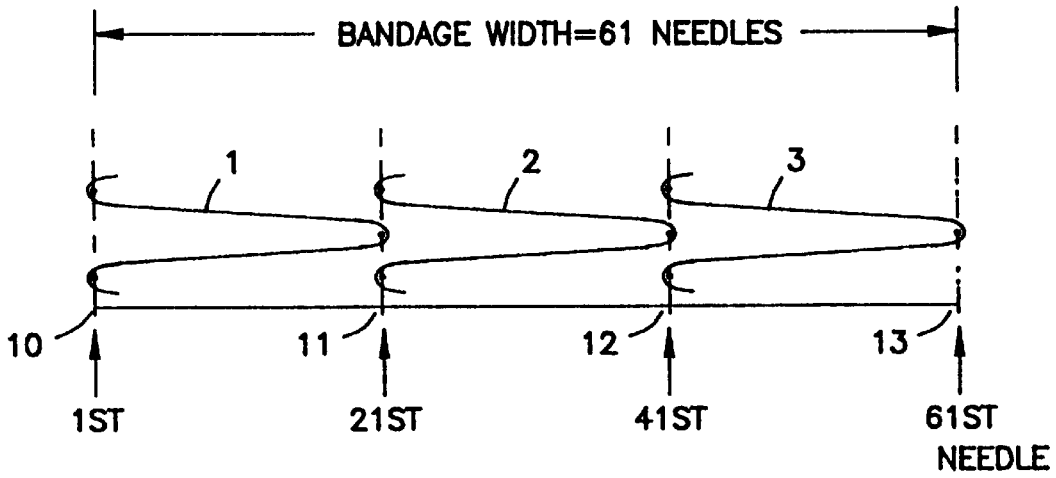
FIG. 2 is a schematic of an alternative embodiment of a fabric having a long weft insertion using 3 individually inserted yarns along the width of the fabric.

Referring to FIG. 2, three individually inserted stiffness-controlling yarns (1, 2, and 3) can be laid in using a lapping guide system for long weft insertions. As shown, each yarn is laid under 21 knitting needles. In this way, the three yarns (1, 2, and 3) cover a typical bandage width (61 needles). The stiffness controlling yarn acting as a weft insertion, however, do not need to pass through the outermost wales of the fabric. In this preferred embodiment, each two adjacent yarns are inserted in an alternate manner around one needle. That is, weft yarn (1) is laid around the first needle (10) and the twenty-first needle (11); weft yarn (2) is laid around the twenty-first needle (11) and the forty-first needle (12); and weft yarn (3) is laid around the forty-first needle (12) and the sixty-first needle (13). As a result, these long weft insertion yarns are interlocked across the fabric width. If a bandage width is larger, additional weft yarns could be used.

Figure 3:
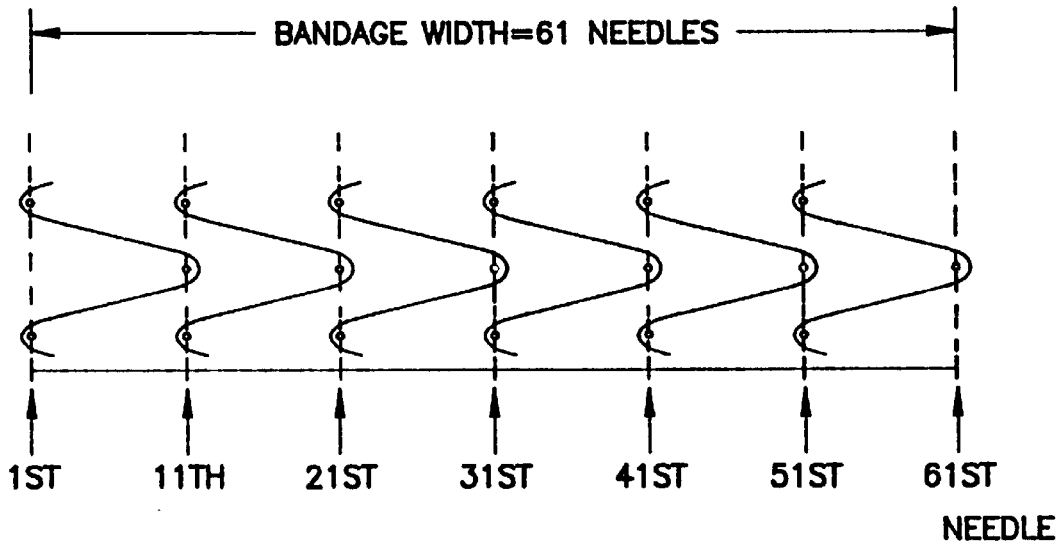
FIG. 3 is a schematic of an alternative embodiment of a fabric having a long weft insertion using 6 individually inserted yarns along the width of the fabric.

Alternatively, for the same bandage width, more yarns can be used resulting in shorter segments. This is represented by the schematic of FIG. 3 wherein each of 6 yarns are laid in across 11 needles for a total fabric width equivalent to the fabric represented in FIG. 2. Using the principles of long weft insertion for making the fabrics represented by FIGS. 2 and 3, the length of cross web direction segments can be changed. For example, 10 weft insertion yarns can be used across the width of the fabric. In this embodiment, the first weft yarn would be inserted under the first and seventh needles, the second weft yarn would be inserted under the seventh and thirteenth needles, the third weft yarn would be inserted under the thirteenth and nineteenth needles, etc.

Figure 4A:
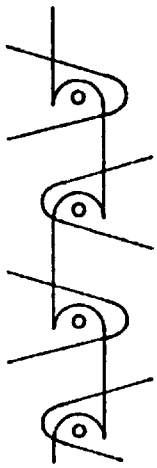
FIG. 4*a* is a detailed view of a schematic of a long weft insertion showing the insertion of two yarns laid by adjacent tubular lapping guide elements under the same knitting needle forming one vertical wale of chain stitch.
Figure 4B:
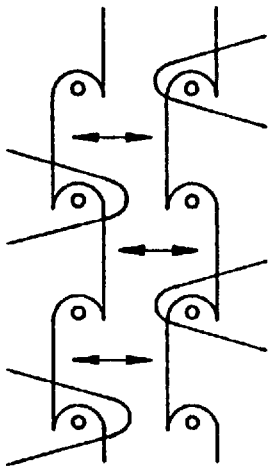
FIG. 4*b* is a detailed view of a schematic of a long weft insertion showing an alternative insertion of two yarns laid into two adjacent wales of chain stitch.

FIGS. 4*a* and 4*b* provide further detailed views of the fabric at the location where adjacent weft insertion yarns overlap. FIG. 4*a* is a detailed view of a schematic of a long weft insertion showing the insertion of two yarns laid by adjacent tubular lapping guide elements under the same knitting needle joining one vertical wale of chain stitch. This is the manner in which the adjacent weft insertion yarns are oriented in the fabric represented by FIGS. 2 and 3. FIG. 4*b* is a detailed view of a schematic of a long weft insertion showing an alternative insertion of two yarns laid into two adjacent wales of chain stitch. Alternating insertion of two adjacent weft yarns, as shown in FIG. 4*a*, i.e., one from the left and then one from the right in a subsequent stitch in reverse order into the same wale, allows for balance in the cross-directional tension of these yarns. Furthermore, this prevents the pulling of two adjacent wales of chain stitch apart, which could occur with the fabric represented by the schematic of FIG. 4*b*, wherein, two weft yarns are inserted into two adjacent wales of chain stitch.

By adjusting the denier of the stiffness-controlling yarn, the number of stiffness-controlling yarns per stitch, and the number of needles each stiffness-controlling yarn crosses, the cross web stability and extensibility can be tailored. For example, higher denier monofilaments or multiple lower denier monofilaments that overlap will result in a backing with higher cross web stiffness. Similarly, the higher the number of needles crossed, the stiffer the backing in the cross web direction. This is balanced with the cross web extensibility desired. For nonoverlapping stiffness controlling insertions, the fewer number of needles traversed, the less cross web stability, but the greater the cross web extensibility. The short weft in-lay system contains generally the same number of yarns per unit width as the number of needles, e.g., 6 ends per centimeter width in a 6 gauge knit, and can be laid in across the desired number of needles. Preferably, the short weft in-lay is laid in under 3 or 4 needles so every end is locked under 3 or 4 wales of chain stitch and provides the cross web integrity of the backing. Using the known warp knit structure of base chain stitch, a weft in-lay, and an independent weft insertion, the preferred fabric of the invention includes the microdenier fiber yarn in the shorter weft in-lay system and the stiffness-controlling yarn in the long weft insertion system, with the heat shrinkable yarn in the core chain stitch forming system. This preferred configuration provides significant advantage, particularly when used in orthopedic support materials. That is, for example, the fabric of the present invention has advantageous extensibility, conformability, flexibility, cross web stability, resin loading capacity, etc.

The cross web stability can be determined by measuring the "hand," i.e., flexibility, of a fabric on a Handlometer. As used herein, "hand" refers to the combination of resistance due to the surface friction and flexibility of a fabric. FIG. 5 represents a typical "hand" testing apparatus, as for example a Model #211-300 Twing-Albert Handle-O-Meter. This apparatus measures the flexibility and the resistance due to surface friction of a sample of fabric by detecting the resistance a blade, i.e., a load cell fixture (1), encounters when forcing a sheet of fabric (2) into a slot (3) with parallel edges having a slot width of 0.25 inches (0.64 cm).

FIG. 6 illustrates the hand of standard Scotchcast Plus® fiberglass fabric (3M Company, St. Paul, Minn.) compared to a polyester (PE) fabric without the monofilament yarn (Example 3) and a fabric containing a single 180 denier low shrink nylon monofilament per stitch with each monofilament laid in across 21 needles in a 6 gauge knit (Example 4). FIG. 3 indicates that the cross web "hand" can be increased using the monofilament yarn to a point where the fabric does not wrinkle; however, the "hand" is not increased to a level as high as that of the fiberglass fabric. Thus, a fabric containing the monofilament yarn has improved conformability relative to a conventional fiberglass fabric. As a result, with a combination of a microdenier weft and an added monofilament weft, a fabric with high resin holding capacity and a soft "hand" that does not wrinkle during application is possible.

As produced, the monofilament is relatively stiff and prefers to remain in a straight orientation. Nevertheless, once it is incorporated into the knit it is forced to zig zag through the knit as it is laid in across the needles. The tendency of the monofilament yarn to return to a straight condition actually puts forces on the knit which will reduce the extensibility and especially the rebound, i.e., the amount of stretch gained on consecutive stretching and relaxing. In order to reverse this tendency, the monofilament is annealed in the "as knit" orientation. In this condition, the monofilament will act as a "spring" and tend to draw the knit back in after it is stretched. After annealing, the preferred orientation is the knitted condition. Since the annealing is done after fully heat shrinking the fabric the preferred orientation is the fully shrunk condition. Therefore, the monofilament after annealing offers a restoring force which will actually increase the rebound. The fabrics of the present invention can be coated with any curable resin system with which the yarns of the fabric do not substantially react. Preferably the resin is water curable. Water-curable resins include polyurethanes, cyanoacrylate esters, isocyanate functional prepolymers of the type described in U.S. Pat. No. 4,667,661. Other resin systems which can be used are described in U.S. Pat. Nos. 4,574,793, 4,502,479, 4,433,680, 4,427,002, 4,411,262, 3,932,526, 3,908,644 and 3,630,194. Preferably, the resin is that described in European Published Application 0407056.

Generally, a preferred resin is coated onto the fabric as a polyisocyanate prepolymer formed by the reaction of an isocyanate and a polyol. The isocyanate preferably is of a low volatility, such as diphenyl-methane diisocyanate (MDI), rather than a more volatile material, such as toluene diisocyanate (TDI). Suitable isocyanates include 2,4-toluene diisocyanate, 2,6-toluene diisocyanate, mixtures of these isomers, 4,4'-diphenylmethane diisocyanate, 2,4'diphenylmethane diisocyanate, mixtures of these isomers together with possible small quantities of 2,2'-diphenylmethane diisocyanate (typical of commercially available diphenylmethane diisocyanate), and aromatic polyisocyanates and their mixtures such as are derived from phosgenation of the condensation product of aniline and formaldehyde. Typical polyols for use in the prepolymer system include polypropylene ether glycols (available from Arco under the trade name Arcol™ PPG and from BASF Wyandotte under the trade name Pluracol™), polytetramethylene ether glycols (Terethane™ from DuPont), polycaprolactone diols (Niax™ PCP series of polyols from Union Carbide), and polyester polyols (hydroxy terminated polyesters obtained from esterification of dicarboxylic acids and diols such as the Rucoflex™ polyols available from Ruco division, Hooker Chemicals Co.). By using high molecular weight polyols, the rigidity of the cured resin can be reduced.

An example of a resin useful in the casting material of the invention uses an isocyanate known as Isonate™ 2143L available from the Dow Chemical Company (a mixture containing about 73% of MDI) and a polypropylene oxide polyol from Arco as Arcol™ PPG725. To prolong the shelf life of the material, it is preferred to include from 0.01 to 1.0 percent by weight of benzoyl chloride or another suitable stabilizer.

The reactivity of the resin once it is exposed to the water curing agent can be controlled by the use of a proper catalyst. The reactivity must not be so great that: (1) a hard film quickly forms on the resin surface preventing further penetration of the water into the bulk of the resin; or (2) the cast becomes rigid before the application and shaping is complete. Good results have been achieved using 4-[2-[1-methyl-2-(4-morpholinyl)ethoxy]ethyl]-morpholine (MEMPE) prepared as described in U.S. Pat. No. 4,871,845 at a concentration of about 0.05 to about 5 percent by weight.

Foaming of the resin should be minimized since it reduces the porosity of the cast and its overall strength. Foaming occurs because carbon dioxide is released when reacts with isocyanate groups. One way to minimize foaming is to reduce the concentration of isocyanate groups in the prepolymer. However, to have reactivity, workability, and ultimate strength, an adequate concentration of isocyanate groups is necessary. Although foaming is less at low resin contents, adequate resin content is required for desirable cast characteristics such as strength and resistance to peeling. The most satisfactory method of minimizing foaming is to add a foam suppressor such as silicone Antifoam A (Dow Corning), Antifoam 1400 silicone fluid (Dow Corning) to the resin. It is especially preferred to use a silicone liquid such as Dow Corning Antifoam 1400 at a concentration of about 0.05 to 1.0 percent by weight.

Most preferably, the resin systems used with the fabrics of the present invention are those containing high aspect ratio fillers. Such fillers can be organic or inorganic. Preferably they are generally inorganic microfibers such as whiskers (highly crystalline small single crystal fibers) or somewhat less perfect crystalline fibers such as boron fibers, potassium titanate, calcium sulfate, asbestos and calcium metasilicate. They are dispersed in about 3–25% by weight of resin amounts to obtain a resin viscosity of about 5–100 centipoise to provide a cured cast with improved strength and/or durability. Such fillers are described in U.S. Pat. No. 5,354,259, which is incorporated herein by reference.

Other fillers may also be used in the curable resin compositions to increase strength of the cast obtained, reduce cost, and alter viscosity, thixotropy or overall fluid flow properties of the curable resin. Fillers can also be used to modify appearance and handling characteristics of the coated sheet material. Useful fillers include, but are not limited to, particulate, spherical, fibrous, microfibrous, flake, or platelet forms including aluminum oxides, calcium metasilicate, titanium dioxide, fumed silica, zeolites, amorphous silica, ground glass, glass fibers, glass bubbles, glass microspheres or mixtures of these materials. Additional fillers include particles of polypropylene, polyethylene, or polytetrafluoroethylene. Such fillers are described in U.S. Pat. No. 5,423,735, which is incorporated herein by reference.

The resin is coated or impregnated into the fabric. The amount of resin used is best described on a filler-free basis, i.e., in terms of the amount of fluid organic resin excluding added fillers. This is because the addition of filler can vary over a wide concentration range, which effects the resin holding capacity of the composite as a whole because the filler itself holds resin and can increase the resin holding capacity. The resin is applied in an amount of about 2–8 grams filler-free resin per gram fabric. The preferred coating weight for a polyester knit of the present invention is about 3.5–4.5 grams filler-free resin per gram fabric, and more preferably about 3.5 grams.

The preparation of the orthopedic casting materials of the present invention generally involves coating the curable resin onto the fabric by standard techniques. Manual or mechanical manipulation of the resin (such as by a nip roller or wiper blade) into the fabric is usually not necessary. However, some manipulation of the resin into the fabric may sometimes be desirable to achieve proper impregnation. Care should be given not to stretch the fabric during resin coating, however, so as to preserve the stretchability of the material for its later application around the desired body part. The material is converted to 10–12 foot lengths and wound on a polyethylene core under low tension to preserve stretch. The roll is sealed in an aluminum foil pouch for storage.

Orthopedic casting materials prepared in accordance with the present invention are applied to humans or other animals in the same fashion as other known orthopedic casting materials. First, the body member or part to be immobilized is preferably covered with a conventional cast padding and/or stockinet to protect the body part. Generally, this is a protective sleeve of an air-permeable abric such that air may pass through the sleeve and the cast to the surface of the skin. Preferably, this sleeve does not appreciably absorb water and permits the escape of perspiration. An example of such a substrate is a knitted or woven crystalline polypropylene material.

Next, the curable resin is typically activated by dipping the orthopedic casting material in water or other aqueous solution. Excess water may then be squeezed out of the orthopedic casting material. The material is wrapped or otherwise positioned around the body part so as to properly conform thereto. Preferably, the material is then molded and smoothed to form the best fit possible and to properly secure the body part in the desired position. Although often not necessary, if desired, the orthopedic casting materials can be held in place during cure by wrapping an elastic bandage or other securing means around the curing orthopedic casting material. When curing is complete, the body part is properly immobilized within the orthopedic cast or splint which is formed.

The orthopedic casting materials of the present invention can be used in tape, sheet, film, slab, or tubular form to prepare orthopedic casts, splints, braces, supports, protective shields, orthotics, and the like. The orthopedic casting materials prepared in accordance with the present invention may optionally comprise catalysts, adjuvants, tack reducing agents, toughening agents, colorants, and/or fragrances, as descried in U.S. Pat. No. 5,423,735.

Preferred Embodiment:

A preferred fabric for use in the casting tape backing of the present invention is a three bar knit of the following construction:

| Composition | Component | Wt % in knit |
|---|---|---|
| a. Front Bar = polyester heat shrinkable yarn | Chain | 30–70% |
| b. Back Bar = polyester microdenier fiber | Weft | 30–70% |
| c. Middle Bar = monofilament | Weft | 3–20% |

More preferably, the knit is a 6 gauge knit composed of the following construction:

| Composition | Component | Wt % in knit |
|---|---|---|
| a. Front Bar = 1/150/68 polyester heat shrinkable yarn | Chain | 38.1 |
| b. Back Bar = 18/2 spun polyester microdenier fiber | Weft | 56.5 |
| c. Middle Bar = 180 denier nylon monofilament (Shakespear SN-40-1) | Weft | 5.3 |

The fabric made from this particularly preferred composition is heat shrunk by passing the fabric under a source of heat, such as a forced hot air gun, at an appropriate temperature (about 150° C.). The heat causes the fabric to shrink under essentially no tension. The fabric was annealed at 175° C. The fabric is then preferably passed through a heated calender (at a temperature of about 80° C.) at 10 pounds per square inch (6.9 N/cm$^2$) and 11 feet per minute (3.4 m/min) to bring the fabric thickness down to about 0.032 inches (0.081 cm). Processed in this way, i.e., with full heat shrinkage followed by calendering, a 3.5 inch (9 cm) wide sample of this particularly preferred knit has approximately 50–60% stretch under a 5 lb. (2.3 kg) load.

A flow chart of the preferred process is shown in FIG. 7. In sum this involves knitting the material on a Raschelina RB crochet type warp knitting machine (see Example 1) wherein the front bar creates a chain stitch of the heat shrinkable yarn, the middle bar lays in the stiffness-controlling yarn in the weft insertion, and the back bar lays in the microdenier yarn as the weft in-lay. The knit fabric is then heat shrunk to the desired percent stretch or extensibility, and then exposed to calendering to the desired thickness.

Yet another method of making a resin-coated sheet material comprises the steps of: (a) knitting a stretch yarn and a nonfiberglass stiffness-controlling yarn with a warp knitting machine to provide a knit fabric, where the stiffness-controlling yarn has a modulus of greater than about 5 grams per denier; (b) shrinking the fabric; (c) calendering the fabric to reduce the thickness of the fabric; and (d) coating a curable resin on the fabric.

The resin-impregnated sheet material of Example 10 is representative of this preferred fabric. Example 10 also describes a particularly preferred resin composition.

Extensibility (Stretch) Test

To perform this test, either an Instron type or a simple stretch table can be used. A stretch table typically has a pair of 15.25 cm wide clamps spaced exactly 10" (25.4 cm) apart. One clamp is stationary and the second clamp is movable on essentially frictionless linear roller bearings. Attached to the movable clamp is a cord that passes over a pulley and is secured to the appropriate weight. A stationary board is positioned on the base of the table with a measuring tape to indicate the lineal extension once the fabric is stretched under to force of the applied weight.

When using a more sophisticated testing machine such as an Instron 1122, the machine is set up with the fabric clamps spaced exactly 10" (25.4 cm) apart. The fabric is placed in the fixtures and tested at a temperature of about 23–25° C. The humidity is controlled at about 50±5% relative humidity. This test is applicable to both resin-coated and uncoated fabrics.

Typically, a piece of unstretched fabric is cut to approximately 12 inches (30.5 cm). Markings are made on the fabric exactly 10" (2.54 cm) apart. If the fabric is coated with a curable resin this operation should be done in an inert atmosphere and the samples sealed until tested. For all samples, it is important to not stretch the samples prior to testing. The fabric is secured in the test fixture under a very slight amount of tension (e.g., 0.01 cN/cm of bandage width) to ensure that the fabric is essentially wrinkle free. The length of the unstretched bandage is 10" (2.54 cm) since the clamps are separated by this distance. If the 10" markings applied do not line up exactly with the clamp, the fabric may have been stretched and should be discarded. In the case of a vertical test set up where the weight of the bandage (especially if resin coated) is sufficient to result in extension of the fabric, the bandage should be secured in the clamps at exactly these marks.

A weight is then attached to the clamp. Unless otherwise indicated, the weight should be 1.5 lb./in width of tape (268 g/cm). The sample is then extended by slowly and gently extending the fabric until the fill weight is released, In cases where an Instron is used, the sample is extended at a rate of 5 inches/minute (12.7 cm/min) until the proper load has been reached. If the fabric continues to stretch under the applied load the percentage stretch is taken one minute after applying the load. The percentage stretch is recorded as the amount of lineal extension divided by the original sample length and this value multiplied by 100. Note that testing of moisture curable resin-coated fabrics must be performed rapidly in order to avoid having cure of the resin effect the results.

The invention has been described with reference to various specific and preferred embodiments and will be further described by reference to the following detailed examples. It is understood, however, that there are many extensions, variations, and modifications on the basic theme of the present invention beyond that shown in the examples and detailed description, which are within the spirit and scope of the present invention.

| Fabric | |
|---|---|
| Yarn: | Micromattique Polyester (Dupont made, texturized by Unify Inc., Greensboro, NC) single yarn, 150 denier, 200 filament (1/150/200) |
| Equipment: | Raschelina RB crochet type warp knitting machine from the J. Muller Co. (360 mm knitted capacity, narrow width) |
| Knit Pattern: | 19 wales/inch (7.5 wales/cm)<br>20 stitches/inch (7.9 stitches/cm)<br>380 openings/inch2 (59 openings/cm$^2$)<br>3.5 inch width (8.9 cm) |
| Fabric Weight: | 2.5 g/ft (0.08 g/cm) |
| Fabric Density: | 0.0124 g/cm$^2$ |
| Thickness: | 0.028 inches (0.071 cm) |

This warp knit microdenier fabric was extremely soft and flexible.

Resin Composition

The fabric was coated with 74 g per 3.66 m of fabric with a filled polyurethane prepolymer resin with the following composition:

| Chemical | Manufacturer | Wt % | Equiv. Weight |
|---|---|---|---|
| Isonate 2143L | Dow Chemical | 54.63 | 144.23 |
| p-toluenesulfonyl chloride | Aldrich Chemical | 0.05 | |
| Antifoam 1400 | Dow Corning | 0.18 | |
| BHT | Aldrich Chemical | 0.48 | |
| MEMPE catalyst | 3M Company | 1.25 | |
| Pluronic F108 | BASF | 4.0 | 7250 |
| Arcol ™ PPG-2025 polyol | Arco Chemical | 25.11 | 1016.7 |
| Niax E-562 polymer polyol | Union Carbide | 8.5 | 1781 |
| Arcol ™ LG-650 polyol | Arco Chemical | 5.91 | 86.1 |

The resin had an NCO/OH ratio of 3.84 and an NCO equivalent weight of 357 g/equivalent. The resin was prepared by addition of the components listed above in 5 minute intervals in the order listed. This was done using a 1 gallon glass mason jar equipped with mechanical stirrer, teflon impeller, and a thermocouple. The resin was heated using a heating mantle until the reaction temperature reached 150–160° F. (65–71° C.) and held at that temperature for 1–1.5 hours. After this time, Nyad G Wollastokup 10012 (available from NYCO, Willsboro, N.Y.) filler was added to make the composition 20% by weight filler. The resin was sealed and allowed to cool on a rotating roller at about 7 revolutions per minute (rpm) overnight. This resin composition was used to coat the fabric. Two coating weights were used. On a filler-free basis, the coating weights were 2.1 grams and 2.33 grams resin per gram fabric (2.6 and 2.9 g/g, including filler, respectively). The resin was applied manually by spreading it over the surface of the fabric and kneading it in until a uniform coating was achieved. The rolls were sealed in an aluminum foil laminate package unti! evaluation.

Dry Ring Strength Test

Rolls of these fabrics were tested for 24-hour dry ring strength with the following results:

| Coating weight | 24 hr Dry (lbs) | Mean (lb/in width) |
|---|---|---|
| 2.1 g filler-free resin/g fabric | 86.1, 112.2, 125.4 | 43.2 (7.7 kg/cm width) |
| 2.33 g filler-free resin/g fabric | 101.1, 144.8, 132.4 | 50.4 (9.0 kg/cm width) |

In this test, the "dry strength" of cured cylindrical ring samples of the resin- coated materials was determined. Each cylindrical ring was made of 6 layers of the resin-coated material. Each cylindrical ring had an inner diameter of 2 inches (5.1 cm). The width of each ring formed was the same as the width of the resin-coated material employed.

Each cylindrical ring was formed by taking a roll of the resin-coated material from its storage pouch and immersing the roll completely in deionized water having a temperature of about 80° F. (27° C.) for about 30 seconds. The roll of resin-coated material was then removed from the water and the material was wrapped around a 2 inch (5.1 cm) mandrel, covered with a thin layer of stockinet such as 3M Synthetic Stockinet MS02, to form 6 complete uniform layers using a controlled wrapping tension of about 45 grams per centimeter width of the material. Each cylinder was completely wound within 30 seconds after its removal from the water.

After 30 minutes from the initial immersion in water, the cured cylinder was removed from the mandrel, and allowed to cure for 48 hours in a controlled atmosphere of 75° F.±3° F. (34° C.±2° C.) and 55%±5% relative humidity. After this time, each cylinder was placed in an Instron instrument fixture for testing.

Once in the instrument fixture, compression loads were applied to the cylindrical ring sample along its exterior and parallel to its axis, Each cylinder was crushed at a speed of about 5 cm/min. The maximum or peak force which was applied while crushing the cylinder was then recorded as the ring strength, which in this particular instance is the "dry strength" (expressed in terms of force per unit length of cylinder). For each material, at least three samples were tested and the average peak force applied was then calculated.

The above-listed dry strength test results indicate that the materials made of microdenier yarns only are quite strong. The dry strength approaches the strength of commercially available fiberglass casting tapes, which are typically 50–60 pounds per inch width (88–105 newtons/cm width).

Porosity Test

The 6 layer rings as made were then tested for porosity by sealing about 25 ml of deionized water in a glass beaker in the middle of a cylindrical ring with a petri dish glued to the top of the ring and one glued to the bottom of the ring. Weight loss of this set-up was recorded over time under ambient conditions. The fabrics were comparable in porosity to fabric used in 3M's Scotchcast Plus® orthopedic casting tape. The results are shown below as an average of two samples:

| | Total Weight Loss (g/sq cm) Microfiber polyester | | Total Weight Loss (g/sq cm) |
|---|---|---|---|
| Day No. | 2.1 g/g | 2.3 g/g | Scotchcast Plus ® |
| 1 | .013 | .013 | .013 |
| 4 | .032 | .034 | .031 |
| 6 | .044 | .046 | .043 |
| 11 | .070 | .070 | .069 |
| 13 | .082 | .081 | .079 |
| 18 | .103 | .100 | .098 |
| 20 | .113 | .109 | .107 |
| 25 | .128 | .123 | .122 |
| 29 | .141 | .136 | .134 |
| 36 | .167 | .157 | .156 |
| 43 | .189 | .175 | .175 |

The linear regression equations for the three products were determined and the slope of the line taken as the rate of water loss. These were: 0.0169 g/cm2/day for the sample containing 2.1 grams resin per gram fabric; 0.0155 g/cm2/day for the sample containing 2.3 grams resin per gram fabric; and 0.0156 g/cm2/day for the sample containing 3M's Scotchcast Plus® orthopedic casting tape (0.0156). This shows that the moisture vapor porosity of these microdenier fabric backings is equal to, or better than, that of the fabric in the fiberglass backing of Scotchcast Plus®.

Example 2

Resin Holding Capacity of Microdenier Fabric

In order to illustrate the higher resin holding capacity of polyester yarns as the filament diameter is reduced, both an 18/2 spun yarn, which has a filament diameter of 1.2 denier, and the 1/150/200 yarn, which has a filament diameter of 0.75 denier were tested. The yarns were tested for the absorbency/holding capacity of Isonate™ 2143L carbodiimide modified 4,4'-diphenylmethane-diisocyanate (available from Dow Chemical, Midland, Mich.) by the following technique.

A sample of 8.5 inches (21.6 cm) of yarn was weighed. The yarn was immersed in Isonate™ 2143L for 30 seconds. It was then removed and gently placed on a Prerniere™ paper towel (available from Scott Paper Co., Philadelphia, Pa.) for 30 seconds to absorb excess resin remaining on the outside of the yarn. The sample was then weighed. The results obtained were as follows:

| Yarn | Filament Diameter (denier) | Initial Wt. (grams) | Final Wt. (grams) | % Increase |
|---|---|---|---|---|
| 1/150/200 PE | 0.75 | .0042 | 0.0249 | 493 |
| | | .0041 | 0.0235 | 473 |
| | | | | mean 483 |
| 18/2 | 1.2 | .0071 | 0.0227 | 220 |
| | | .0074 | 0.0233 | 215 |
| | | | | mean 217 |

This data indicates that the fine 18/2 yarn cannot hold as much resin as the 1/150/200 yarn, even though the 18/2 yarn is greater in mass. Furthermore, the 1/150/200 yarn (0.75 mm filament diameter) can hold over twice as much resin on a percentage basis.

Example 3

Varying the Number of Stitches per Unit Length in Fabric Containing Microdenier Yarn and Heat Shrinkable Yarn A series of 4 knits were made using the same type of input yarns but varying the output speed of the take-up roller in order to vary the number of stitches/inch. The knit was a basic 2 bar knit with the weft yarn laid under 4 needles with 6 needles/cm (6 gauge). The knitting machine used was that used in Example 1.

The chain stitch was a 2/150/34 Power Stretch yarn produced by Unifi (Greensboro, N.C.). This yarn is a 2 ply yarn where each yarn is composed of 34 filaments and is 150 denier, making the overall yarn 300 denier. The weft in-lay yarn was the microdenier yarn used in Example 1 (1/150/200).

The tape was rolled up off the knitting machine under essentially no tension.

The knits were then heat shrunk by passing the fabric around a pair of 6 inch (15 cm) diameter heated (350° F., 176° C.) calender rolls at a speed of 20 ft/minute (6.1 meters/minute) with the rolls held apart. The tapes were then passed through a heated calender in a nip position to "iron" the fabric flat and to decrease the thickness. The following 4 knits were produced in this manner:

| Property | Knit #1 | Knit #2 | Knit #3 | Knit #4 |
|---|---|---|---|---|
| Stitches/inch on machine | 12 | 8.5 | 5.0 | 7.0 |
| Stitch/inch relaxed | 15 | 9.5 | 5.8 | 7.87 |
| Width-working (mm) | 100 | 100 | 100 | 100 |
| Relaxed width before winder (mm) | 85 | 86 | 100 | 90 |
| Finished Heat Set: | | | | |
| Width (mm) | 83 | 83 | 100 | 90 |
| Stitch density/inch | 16 | 13 | 10 | 12.5 |
| Useable % stretch | 29 | 43 | 65 | 40 |
| Thickness before calender (inch) | 0.049 | 0.047 | 0.045 | 0.054 |
| Thickness after calender (inch) | 0.039 | 0.037 | 0.039 | 0.038 |

The thickness was measured using an Ames Model 2 thickness gauge (Ames Gauge Company, Waltham, Mass.) equipped with a one-inch (2.5 cm) diameter contact comparator, by placing the foot down gently onto the fabric. For each sample, the heated calender significantly reduced the tape thickness. Varying the number of stitches per inch produced fabrics of significantly different fabric density, percent stretch, and conformability.

Example 4

Knit Fabric Containing Microdenier Yarn, Heat Shrinkable Yarn, and Monofilament Yarn A knitted backing suitable for use in orthopedic casting was produced according to Example 3, sample Knit #3, except that a 180 denier nylon monofilament SN-40-1 (available from Shakespear Monofilament, Columbia, S.C.) was used as a weft in-lay. Each of three monofilament yarns were laid in across 21 needles in a substantially nonoverlapping configuration to completely fill the width of the fabric (note that two adjacent monofilaments do not overlap each other but are being alternately laid around one common needle, as illustrated in FIG. 5). The fabric was heat shrunk and calendered in an in-line process. The shrinking was accomplished using hot air regulated at 1 50° C. and subsequently calendered using a pair of silicone elastomer-covered 3 inch (7.6 cm) diameter rollers under a force of 87.5 pounds (390 newtons). The fabric had an extensibility of approximately 45%, a width of 3.5 inches (8.9 cm), and a thickness of 0.046 inches (0.12 cm).

The fabric was coated with the following resin system:

| Chemical | Manufacturer | Wt % | Equiv. Weight |
|---|---|---|---|
| Isonate 2143L | Dow Chemical | 57.7 | 144.7 |
| p-toluenesulfonyl chloride | Aldrich Chemical | 0.05 | |
| Antifoam 1400 | Dow Corning | 0.18 | |
| BHT | Aldrich Chemical | 0.48 | |
| MEMPE catalyst | 3M Company | 1.25 | |
| Pluronic F108 | BASF | 4.0 | 7250 |
| Arcol ™ PPG-2025 polyol | Arco Chemical | 20.92 | 1019.3 |
| Niax E-562 polymer polyol | Union Carbide | 9.85 | 1729 |
| Arcol ™ LG-650 polyol | Arco Chemical | 5.75 | 86.1 |

The NCO/OH ratio of this resin was 4.26 and the NCO equivalent weight was 328 g/equivalent. The resin was prepared as described in Example 1 except that 15% by weight Nyad G Wollastokup 10012 was used as a reinforcing filler.

This resin was coated on the fabric at 3.5 grams per gram fabric (2.8 grams filler-free resin per gram fabric).

The tape produced handled well. That is, the final knit was found to be very easy to work with when wrapped dry around artificial legs after dipping in water at ambient temperature and squeezing three times. No wrinkles formed during this operation. The dry strength was measured to be 106.7 lb./in (19 kg/cm) by the method described in Example 1. The ring delamination was measured to be 8.7 lb./in (15.2 newtons/cm) by the Delamination Test outlined below. Typical values for commercially available fiberglass orthopedic casting tape are 50–60 lb./in (88–105 newtons/cm) dry strength with a ring delamination of 5 lb./in (8.8 newtons/cm).

Delamination Test

This test measures the force necessary to delaminate a cured cylindrical ring of a resin-coated material. Each cylindrical ring includes 6 layers of the resin-coated material having an inner diameter of 2 inches (5.1 cm). The width of the ring formed was the same as the width of the resin-coated material employed. The final calculation of the delamination strength is given in terms of newtons per centimeter of tape width.

Each cylindrical ring was formed by taking a roll of the resin-coated material from its storage pouch and immersing the roll completely in deicnized water having a temperature of about 27° C. for about 30 seconds. The roll of resin-coated material was then removed from the water and the material was wrapped around a 2 inch (5.1 cm) mandrel covered with a thin stockinet (such as 3M Synthetic Stockinet MS02) to form 6 complete uniform layers using a controlled wrapping tension of about 45 grams per centimeter width of the material. A free tail of about 6 inches (15.24 cm) was kept and the balance of the roll was cut off. Each cylinder was completely wound within 30 seconds after its removal from the water.

After 15 to 20 minutes from the initial immersion in water, the cured cylinder was removed from the mandrel, and after 30 minutes from the initial immersion in water its delamination strength was determined. This was done by placing the free tail of the cylindrical sample in the jaws of the testing machine, namely, an Instron Model 1122 machine, and by placing a spindle through the hollow core of the cylinder so that the cylinder was allowed to rotate freely about the axis of the spindle. The Instron machine was then activated to pull on the free tail of the sample at a speed of about 127 cm/min. The average force required to delaminate the wrapped layers over the first 33 centimeters of the cylinder was then recorded in terms of force per unit width of sample (newtons/cm). For each material, at least 5 samples were tested, and the average delamination force was then calculated and reported as the "delamination strength."

Example 5

Knit Fabric Containing Microdenier Yarn, Monofilament Yarn, and Smaller Diameter Filament Stretch Yarns A knit fabric similar to that of Example 4 was made using a 2/150/100 stretch polyester yarn in the wale in place of the 2/150/34 Power Stretch yarn, and except that the fabric was not calendered. This stretch yarn has a filament diameter of 1.5 denier/filament as opposed to 4.4 denier/filament for the 2/150/34 yarn. The final product had only 15% stretch and a thickness of 0.027 inches (0.069 cm), as opposed to the 0.046 inch (0.12 cm) thickness of the heat shrunk fabric of Example 4. This indicates that the larger the filament diameter of the shrink/stretch yarn, the greater force is generated to shrink the knit, thereby resulting in a thinner fabric.

Example 6

Single End 2.2 Denier/Filament Stretch Yarn

A knit similar to that of Example 4 was made with a 1/150/68 polyester stretch yarn in the wale in place of the 2/150/34 Power Stretch yarn. This stretch yarn has a filament diameter of 2.2 denier/filament as opposed to 4.4 denier/filament for the 2/150/34 yarn. In addition, the 1/150/200 microdenier weft yarn was replaced with an 18/2 spun polyester yarn produced by Dixie Yarns. The final product had a 45% stretch and a thickness of 0.036 inches (0.091 cm).

Other knit properties include: relaxed stitch density=2.5 stitches/cm; relative weights of fabric components (chain component: 38.1% by weight; weft component: 56.5% by weight; monofilament: 5.3% by weight); shrunk stitch density=3.4 stitches/cm; and width=92 mm. This experiment indicates that a lower basis weight fabric can be produced with a high degree of stretch yarn with a filament size of 2.2 denier.

Example 7

Effect of Shrinking Fully Prior to Calendering

A knit similar to that of Example 6 was made but this time the knit was not fully heat shrunk prior to calendering and "ironing" the fabric. After the operation, the fabric had only 13–20% stretch under a 5 lb.(2.3 kg) load and a thickness of 0.032 inches (0.081 cm). This is markedly less than the 45% stretch observed in Example 6. The fabric was exposed to hot air once again but the fabric could not be shrunk to any significant degree. Therefore, it is important to fully shrink the fabric to the desired extensibility prior to the calendering operation if a high percent shrinkage is desired.

Example 8

Monofilament In-Lay Variation

Three knits were prepared using the following yarns:

Chain Stitch—1/150/68 polyester stretch yarn (Dalton Textiles, Oak Brook, Ill.);

Weft In-Lay Yarn—18/2 spun polyester microdenier yarn (Dalton Textiles); and

Weft Insertion Yarn—180 denier nylon monofilament (Shakespear Monofilament, SN-40-1)

The knit was produced using a 6 gauge needle bed (6 needles/cm). The 18/2 spun polyester microdenier yarn was laid across 3 needles. The total knit was produced using 61 needles. The monofilament was laid in across varying numbers of needles in three separate knits. This is shown below:

| | | Cross Web % Stretch | |
|---|---|---|---|
| Monofilament Weft Insertion | Number of Monofilaments Per Knit Width | 1 lb/in Load | 1.5 lb/in Load |
| 21 needles | 3 | 4.79 | 20.4 |
| 13 | 5 | 8.87 | 32.9 |
| 7 | 10 | 18.77 | 63.4 |

The knits were heat shrunk off the knitter using a Leister hot air gun set at 150° C. The knits were tested for extensibility in the width or cross web direction on an Instron 1122 (average of 2 samples). The extensibility was taken as the percent stretch under a load of 1.0 lb/in (0.47 kg/cm) and 1.5 lb/in (0.7 kg/cm) when stretched at a rate of 5 inches per minute. Clearly the % stretch in the cross web direction increases substantially as the number of monofilaments increases. The knits were coated with the resin of Example 4 and converted into 10.5 foot rolls under minimal tension. In all cases the knit still draped and molded without wrinkling. This indicates that the extensibility in the width direction can be tailored while maintaining a flat and wrinkle free web.

Example 9

Annealing the Monofilament for Rebound Improvement

A fabric containing a monofilament was annealed to impart a restoring force that increases rebound by placing a sample of the knits disclosed in Example 8 in an oven at 175° C. for 15 minutes. A monofilament was extracted and found to retain the as-knitted shape very well. It should be noted that a monofilament removed from the non-annealed control was not completely straight due to some annealing which occurred during the heat shrink operation. This indicates that the heat shrinking and annealing could be accomplished in a single step if the temperature and duration at that temperature was sufficient. Furthermore, a monofilament with an annealing temperature somewhat lower than the heat shrink temperature may be preferred. Note that by varying the denier of the monofilament the amount of restoring force can be adjusted.

Example 10

Preferred Casting Tape Backing

A knitted backing suitable for use in orthopedic casting was produced using the following components:

| Composition | Component |
|---|---|
| Front Bar = polyester (Dalton Textiles, Oak Brook, IL) 1/150/68 heat shrinkable yarn | Chain |
| Back Bar = spun polyester (Dalton Textiles, Oak Brook, IL) 18/2 microdenier yarn | Weft in-lay |
| Middle Bar = 180 denier nylon monofilament (Shakespear Monofilament, Columbia, SC) (Shakespear SN-40-1) | Weft insertion |

The knit was constructed using a total of 61 needles in a metric 6 gauge needle bed on a Raschelina RB crochet type warp knitting machine from the J. Mucller of America, Inc.

The basic knit construction was made with the chain on the front bar and the weft in-lay under 3 needles on the back bar. The middle bar was used to inlay a total of 10 monofilament weft insertion yarns each passing over 7 needles. The weft insertion yarns were mutually interlocked across the bandage width being alternatively laid around one common needle, e.g., weft insertion yarn No. 1 was laid around needles No. 1 and 7, weft insertion yarn No. 2 around needles No. 7 and 13, etc. The fabric made from this particularly preferred composition was heat shrunk by passing the fabric under a forced hot air gun set to a temperature of 150° C. The heat caused the fabric to shrink as the web was wound up on the core under essentially no tension. The fabric was then heated in loose roll form at 175° C. for 20 minutes to anneal the monofilament yarn in the shrunk condition. After cooling, the fabric was passed through a heated calender roll (79° C.) to bring the fabric thickness down to about 0.038–0.040 inches (0.97 mm–1.02 mm). Processed in this way, i.e., with full heat shrinkage followed by calendering, a fabric with the following properties was produced:

| Property | Measured Result |
|---|---|
| Width (cm) | 9.5 |
| Basis weight (g/sq m) | 150 |
| Thickness (mm) | 0.97–1.02 |
| Stitches/inch | 9 |
| Wales/inch | 16 |
| Openings/sq inch | 144 |
| Extensibility (%) length | 46.3* |
| Extensibility (%) width | 63.4* |

*Note that the lengthwise extensibility was measured under a load of 5 lb (22.2 N) and the widthwise extensibility was measured under a load of 1.5 lb/in (2.63 N/cm).

Resin Composition

The fabric described above was coated with the following resin composition:

| Chemical | Manufacturer | Wt % | Equiv. Weight |
|---|---|---|---|
| Isonate 2143L | Dow Chemical | 56.8 | 144.3 |
| p-toluenesulfonyl chloride | Aldrich Chemical | 0.05 | |
| Antifoam 1400 | Dow Corning | 0.18 | |
| BHT | Aldrich Chemical | 0.48 | |
| MEMPE catalyst | 3M Company | 1.15 | |
| Pluronic F108 | BASF | 5.0 | 7250 |
| Arcol ™ PPG-2025 polyol | Arco Chemical | 22.2 | 1016.7 |
| Niax E-562 polymer polyol* | Union Carbide | 8.5 | 1781 |
| Arcol ™ LG-650 | Arco Chemical | 5.6 | 86.1 |

*Formerly available from Union Carbide, now available from Arco Chemical Company as Poly 24-32.

The resin had an NCO/OH ratio of 4.25 and an NCO equivalent weight of 332.3 g/equivalent. The resin was prepared by addition of the components listed above in 5 minute intervals in the order listed. This was done using a 1 gallon glass mason jar equipped with a mechanical stirrer, teflon impeller, and a thermocouple. The resin was heated using a heating mantle until the reaction temperature reached 65–71° C. and held at that temperature for about 1–1.5 hours. After this time, Nyad G Wollastokup 10012 (available from Nyco, Willsboro, N.Y.) filler was added to make the composition 20% by weight filler. The reaction vessel was sealed and allowed to cool on a rotating roller at about 7 revolutions per minute (rpm) overnight. This filled resin composition was coated on the above described fabric at a coating weight of 3.5 g filled resin/g fabric (2.8 g/g fabric on a filler free basis). The coating was performed under minimal tension to avoid stretching the fabric by spreading the resin directly on one surface. The coated fabric was converted into 3.35 m rolls wrapped around a 1.2 cm diameter polyethylene core. The converting operation was also done under minimal tension to avoid stretching the fabric. The rolls were then placed into aluminum foil laminate pouches until later evaluation.

The material was evaluated by removing the roll from the pouch, dipping under 23–25° C. water with three squeezes, followed by a final squeeze to remove excess water and wrapping on a forearm. The material was found to be very conformable and easy to work with without wrinkling. The cast became very strong in a short amount of time (less than 20–30 minutes) and had a very pleasing appearance. Note that when the tape was immersed in water it quickly became very slippery. The roll unwound easily and did not stick to the gloves of the applier. Molding was easy due to the non-tacky nature of the resin. The cast was rubbed over its entire length without sticking to the gloves and the layers bound well to each other. The final cured cast had a much smoother finish than typical fiberglass casting materials. The cast could also be drawn on and decorated with felt tipped marker much more easily than fiberglass casting materials and the artwork was much more legible.

All patents, patent documents, and publications cited herein are incorporated by reference. The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

What is claimed is:

1. A resin-coated sheet material comprising:

(a) a knit fabric comprising a low modulus organic yarn having a modulus of about 5 to about 100 grams per denier;

(b) a nonfiberglass stiffness-controlling yarn knit into the fabric as weft insertions, the stiffness-controlling yarn having a modulus of greater than about 5 grams per denier and comprising about 3 to 20 percent by weight of the total fabric weight; and (c) a curable resin coated on the fabric wherein the stiffness-controlling yarn reduces wrinkling in the fabric during application of the resin-coated sheet material to a body part.

2. The resin-coated sheet material of claim 1, wherein the stiffness-controlling yarn has less than 15% shrinkage.

3. The resin-coated sheet material of claim 1, wherein the fabric includes a stretch yarn.

4. The resin-coated sheet material of claim 3, wherein the stretch yarn is a heat shrinkable, thermoplastic yarn.

5. The resin-coated sheet material of claim 1, wherein the stiffness-controlling yarn is a monofilament yarn.

6. The resin-coated sheet material of claim 1, wherein the stiffness-controlling yarn has a denier between 80 and 350.

7. The resin-coated sheet material of claim 1, wherein the fabric comprises two or more of the weft insertion yarns and wherein the weft insertion yarns do not pass through the outermost wales of the fabric.

8. The resin-coated sheet material of claim 1, wherein the material is an orthopedic casting tape or a casting splint.

9. The resin-coated sheet material of claim 8, wherein the curable resin further comprises a filler.

10. The resin-coated sheet material of claim 9, wherein the filler comprises glass bubbles.

11. The resin-coated sheet material of claim 9, wherein the filler comprises microfibers.

12. The resin-coated sheet material of claim 9, wherein the filler is calcium metasilicate.

13. The resin-coated sheet material of claim 1, wherein the resin is water curable.

14. The resin-coated sheet material of claim 13, wherein the water-curable resin is an isocyanate functional prepolymer.

15. A resin-coated sheet material comprising:

(a) a knit fabric comprising an organic-filament yarn, wherein the fabric has been calendered to not more than 30% of the fabric original thickness; and (b) a water curable resin coated on the calendered fabric.

16. The resin-coated sheet material of claim 15, wherein the fabric includes a stretch yarn.

17. The resin-coated sheet material of claim 15, wherein the fabric includes a fiberglass yarn.

18. A method of making a resin-coated sheet material, comprising the steps of:

(a) knitting a stretch yarn and a nonfiberglass stiffness-controlling yarn with a warp knitting machine to provide a knit fabric, wherein the stiffness controlling yarn has a modulus of greater than about 5 grams per denier;

(b) shrinking the fabric;

(c) calendering the fabric to not more than 30% of the fabric original thickness; and (d) coating a curable resin on the fabric.

19. The method of claim 18, wherein the step of shrinking the fabric is carried out with hot air at a temperature of about 120–180° C.

20. The method of claim 19, wherein the step of shrinking the fabric is carried out fully before the step of calendering the fabric.

21. The method of claim 19, wherein the step of shrinking the fabric is carried out simultaneously with the step of calendering the fabric.

22. The method of claim 19, further comprising a step of annealing the fabric to set the stiffness controlling yarn in its knitted orientation, wherein the annealing step occurs between the calendering step and the coating step.

23. A resin-coated sheet material comprising:

(a) a knit fabric comprising a monofilament nonfiberglass stiffness-controlling yarn having an elastic modulus of greater than about 5 grams per denier; and (b) a curable resin coated on the fabric.

24. The resin-coated sheet material of claim 23, wherein the stiffness-controlling yarn has less than 15% shrinkage.

25. The resin-coated sheet material of claim 23, wherein the fabric includes a stretch yarn.

26. The resin-coated sheet material of claim 23, wherein the stiffness-controlling yarn is capable of being annealed in an as knit orientation.

* * * * *

UNITED STATES PATENT AND TRADEMARK OFFICE

CERTIFICATE OF CORRECTION

PATENT NO. : 6,159,877
DATED : December 12, 2000
INVENTOR(S) : Scholz, Matthew T.

It is certified that error appears in the above-identified patent and that said Letters Patent is hereby corrected as shown below:

Column 15,
Line 55, delete "abric" and insert in place thereof -- fabric --.

Column 16,
Line 15, delete "descried" and insert in place thereof -- described --.

Column 18,
Line 63, delete "unti!" and insert in place thereof -- until --.

Column 19,
Line 41, delete "axis," and insert in place thereof -- axis. --.

Column 20,
Line 42, delete "Prernier™" and insert in place thereof -- Premiere™ --.

Column 21,
Line 62, delete "1 50° C." and insert in place thereof -- 150° C. --.

Column 22,
Line 47, delete "deicnized" and insert in place thereof -- deionized --.

Column 24,
Line 67, delete "Mucller" and insert in place thereof -- Mueller --.

Signed and Sealed this

Twenty-first Day of May, 2002

*Attest:*

*Attesting Officer*

JAMES E. ROGAN
*Director of the United States Patent and Trademark Office*